US007134561B2

(12) United States Patent
Schneider et al.

(10) Patent No.: US 7,134,561 B2
(45) Date of Patent: Nov. 14, 2006

(54) SYSTEMS, DEVICES AND METHODS FOR CLOTHING ORGANIZATION

(75) Inventors: Boris Schneider, Reading, PA (US); Jorge L. Prats, River Edge, NJ (US)

(73) Assignee: Ribs Marketing, Inc., West Reading, PA (US)

( * ) Notice: Subject to any disclaimer, the term of this patent is extended or adjusted under 35 U.S.C. 154(b) by 0 days.

(21) Appl. No.: 10/991,462

(22) Filed: Nov. 19, 2004

(65) Prior Publication Data

US 2005/0109721 A1 May 26, 2005

Related U.S. Application Data

(60) Provisional application No. 60/481,683, filed on Nov. 21, 2003.

(51) Int. Cl.
*A47F 5/08* (2006.01)
*A47H 1/00* (2006.01)

(52) U.S. Cl. ..... 211/118; 211/89.01; 211/104; 211/124; 211/175

(58) Field of Classification Search ..... 211/118, 211/116, 113, 104, 175, 124, 89.01, 123; 248/290.1, 324, 294.1, 333, 304, 340, 341; 223/89, 94, 88, 85
See application file for complete search history.

(56) References Cited

U.S. PATENT DOCUMENTS

| | | | | |
|---|---|---|---|---|
| 1,743,234 | A * | 1/1930 | Porter | 223/94 |
| 1,966,283 | A * | 7/1934 | Brody | 211/123 |
| 2,011,792 | A * | 8/1935 | Beplate et al. | 211/118 |
| 2,605,942 | A * | 8/1952 | Comer et al. | 223/89 |
| 2,699,263 | A * | 1/1955 | Ore | 211/113 |
| 4,129,218 | A * | 12/1978 | Koellner | 211/116 |
| 4,162,730 | A * | 7/1979 | Steere et al. | 211/118 |
| 4,518,089 | A * | 5/1985 | Campbell | 211/118 |
| 4,595,106 | A * | 6/1986 | Kunze et al. | 211/118 |
| 4,717,053 | A * | 1/1988 | Wang | 223/94 |
| 4,813,581 | A | 3/1989 | LaMont | |
| 4,953,717 | A | 9/1990 | Rösch | |
| 4,972,961 | A * | 11/1990 | Roesch | 211/116 |
| 5,065,915 | A * | 11/1991 | Rosch | 223/89 |
| 5,107,996 | A * | 4/1992 | Whittaker | 211/116 |
| 5,385,245 | A * | 1/1995 | Waters | 211/85.3 |
| 5,405,065 | A | 4/1995 | Olson | |
| 5,836,486 | A * | 11/1998 | Ohsugi | 223/85 |
| 5,901,888 | A | 5/1999 | Schneider et al. | |
| 6,257,421 | B1 * | 7/2001 | Outten | 211/40 |
| 6,302,281 | B1 * | 10/2001 | Wang | 211/118 |
| RE37,715 | E * | 5/2002 | Graham | 223/89 |
| 6,520,351 | B1 * | 2/2003 | Zadro | 211/119 |
| 6,719,157 | B1 * | 4/2004 | Stoddart et al. | 211/118 |

* cited by examiner

*Primary Examiner*—Jennifer E. Novosad
(74) *Attorney, Agent, or Firm*—Lowe Hauptman & Berner, LLP.; James J. Bindseil

(57) ABSTRACT

Systems, devices and methods for clothing organization include a first member, including a first hanger positioning portion, connectable to a second member. The two members may be movable between a first relative position and a second relative position, such as for loading/unloading and storage of conventional hangers. Additionally, a first suspension mechanism is attachable to the first member and, in one embodiment, a second suspension mechanism is attachable to the second member. The first suspension mechanism and the second suspension mechanism respectively support the first member and the second member in the first relative position and the second relative position. Associated methods of assembly of such hanger systems, and methods of clothing organization, are also disclosed.

34 Claims, 6 Drawing Sheets

SYSTEMS, DEVICES AND METHODS FOR CLOTHING ORGANIZATION

CROSS REFERENCE TO RELATED APPLICATIONS

The present application claims priority to U.S. patent application Ser. No. 60/481,683, filed Nov. 21, 2003, hereby incorporated by reference.

BACKGROUND

The described embodiments relate to a hanger, and more particularly, to systems, devices and methods of clothing organization.

Most clothing organization systems poorly utilize all available space, such as the space available in a closet. The typical "bar and hanger" system requires hangers to be spaced horizontally, requiring sufficient space between each hanger to accommodate clothing. This arrangement typically does not allow for the effective use of the vertical and horizontal space within the closet or other storage space. In addition, most clothing organization systems do not allow for the "compression" of clothing.

More advanced clothing organization systems typically cause a user difficulty in storing and retrieving the clothing items. Typically, the clothing items must be rearranged in some manner to facilitate storage and retrieval of some or all items.

Further, clothing storage systems are not generally designed so that entire "outfits" of clothing can be stored together. This causes the user to have to search through multiple hangers to retrieve all clothing to complete their "outfit."

Thus, it appears that there is a need for a system, device and/or method of clothing organization that improves upon and/or avoids at least one of the disadvantages of presently available systems.

BRIEF SUMMARY

In accordance with one aspect, the disclosed embodiments provide systems, devices and methods for efficiently storing conventional hangers and/or their associated clothing items.

In one embodiment, a hanger system comprises a first member having a first hanger positioning portion and a second member connectable to the first member such that the second member and the first member are movable between a first relative position and a second relative position. The system further includes a first suspension mechanism attachable to the first member and a second suspension mechanism attachable to the second member. The first suspension mechanism and the second suspension mechanism are operable to respectively support the first member and the second member in the first relative position and the second relative position.

In another embodiment, a hanger system comprises a first member having a first hanger positioning portion and a second member connectable to the first member at corresponding ends thereof such that the second member and the first member are movable between a first position and a second position relative to one another. The system further includes a first suspension mechanism attachable to an opposing end, opposite the corresponding ends, of one of the first member and the second member. The first suspension mechanism is operable to support the respective one of the first member and the second member in the first relative position and the second relative position.

In a further embodiment, a hanger system comprises a first member having a means for holding a plurality of conventional hangers and a means for connecting a second member to the first member at corresponding ends thereof such that the second member and the first member are movable between a first position and a second position relative to one another, the second member having a second means for holding a plurality of conventional hangers. The system further includes a first means for movably suspending the first member, the first means for suspending attachable to a first opposing end of the first member, opposite the corresponding ends. Also, the system includes a second means for movably suspending the second member, the second means for suspending attachable to a second opposing end of the second member, opposite the corresponding ends.

In still another embodiment, a hanger system kit comprises a first member having a first mounting area and a second member connectable to the first member at corresponding ends thereof such that the second member and the first member are movable between a first position and a second position relative to one another. The kit further includes a first attachment member having a first plurality of hang locations with a first set of predetermined spacings therebetween, the first attachment member removably attachable to the first mounting area. Also, the kit includes a second attachment member having a second plurality of hang locations with a second set of predetermined spacings therebetween, the second attachment member removably attachable to the first mounting area. Also included in the kit is a first suspension mechanism attachable to an opposing end, opposite the corresponding ends, of one of the first member and the second member. The first suspension mechanism is operable to support the respective one of the first member and the second member in the first relative position and the second relative position.

In yet another embodiment, a method of assembling a hanger system includes connecting a first member having a first hanger positioning portion to a second member such that the second member and the first member are movable between a first position and a second position relative to one another. Further, the method includes connecting a first suspension member to one of the first member and the second member, where the first suspension member movably supports the respective one of the first member and the second member during movement between the first position and the second position. Additionally, the method may further include removably attaching the first hanger positioning portion to the first member. Another alternative to the method includes connecting a second suspension member to the other one of the first member and the second member, where the second suspension member movably supports the other one of the first member and the second member during movement between the first position and the second position. Further, the first suspension member and the second suspension member have a first spacing corresponding to the first position of the members and a second spacing corresponding to the second position of the members, where the first spacing is greater than the second spacing.

In another embodiment, a method of clothing organization includes hanging a hanger system by a first suspension mechanism and a second suspension mechanism, where the first suspension mechanism is attached to a first end of a first member and the second suspension mechanism is attached to a second end of the second member. The first member and the second member are movably connected at corresponding ends thereof, opposite the first end and the second end, such that the members are movable between a first position and a second position relative to one another. Further, the first member includes at least one hang location. Additionally, the method includes hanging at least one conventional hanger at the hang location while the members are in the first position, where the first suspension member and the second suspension member have a first spacing corresponding to the first position. And, the method includes moving the members into the second position, where the first suspension member and the second suspension member have a second spacing corresponding to the second position, where the first spacing is greater than the second spacing.

Additional aspects and advantages of the disclosed embodiments are set forth in part in the description which follows, and in part are obvious from the description, or may be learned by practice of the disclosed embodiments. The aspects and advantages of the disclosed embodiments may also be realized and attained by the means of the instrumentalities and combinations particularly pointed out in the appended claims.

BRIEF DESCRIPTION OF THE DRAWINGS

The disclosed embodiments will hereinafter be described in conjunction with the appended drawings provided to illustrate and not to limit the disclosed embodiments, wherein like designations denote like elements, and in which.

DETAILED DESCRIPTION

Figure 1:
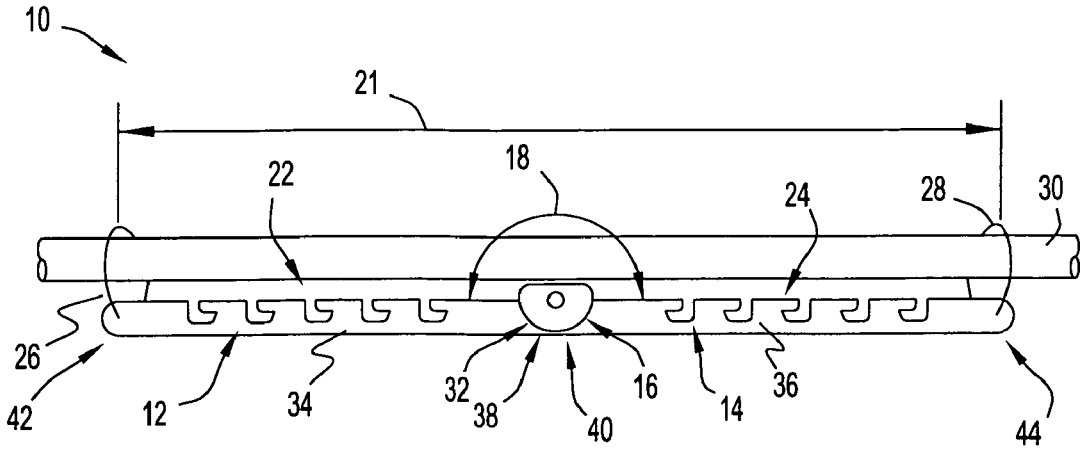
FIG. 1 is a front view of one embodiment of a hanger system having hanger positioning portions defined on two movable members in a first relative position, such as a loading/unloading position.
Figure 2:
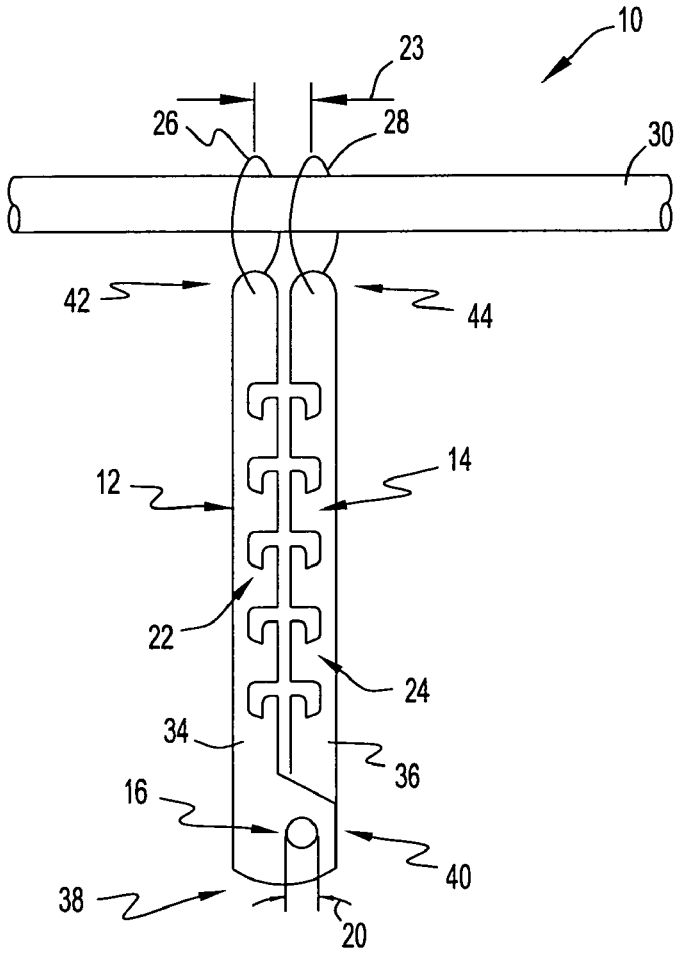
FIG. 2 is a front view of the system of FIG. 1 with the members in a second relative position, such as a storage position.
Figure 3:
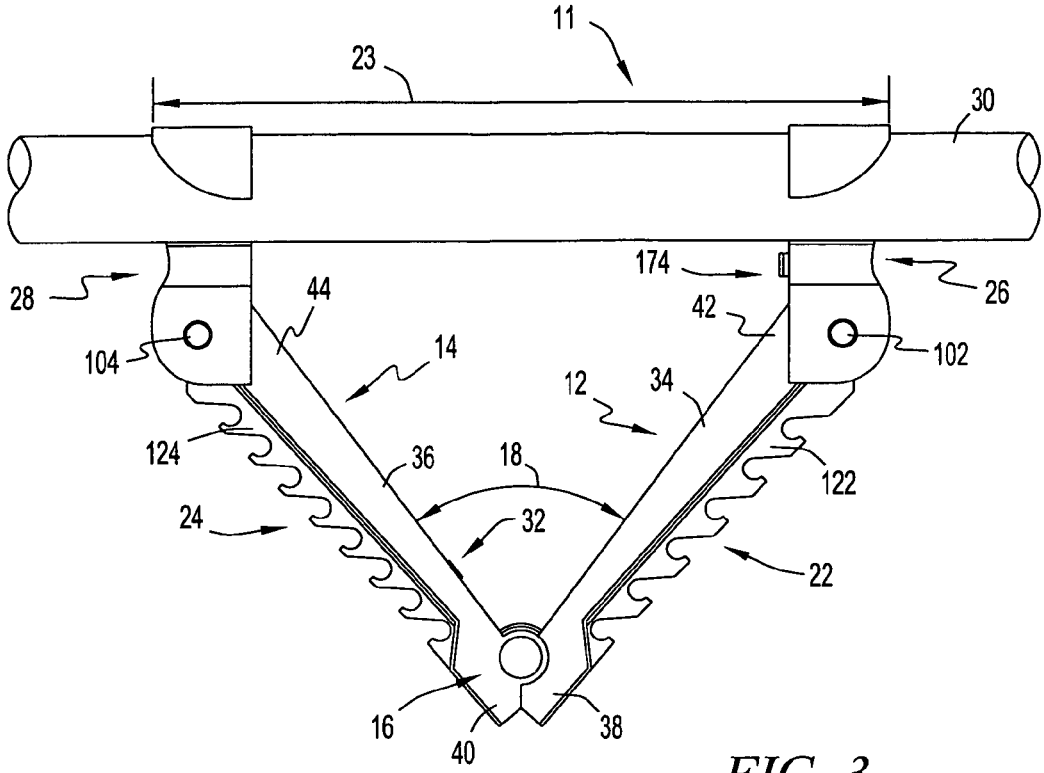
FIG. 3 is a rear view of another hanger system, similar to the hanger system of FIG. 1, having the hanger positioning portions defined on removable attachment members, and in a different loading/unloading position.
Figure 4:
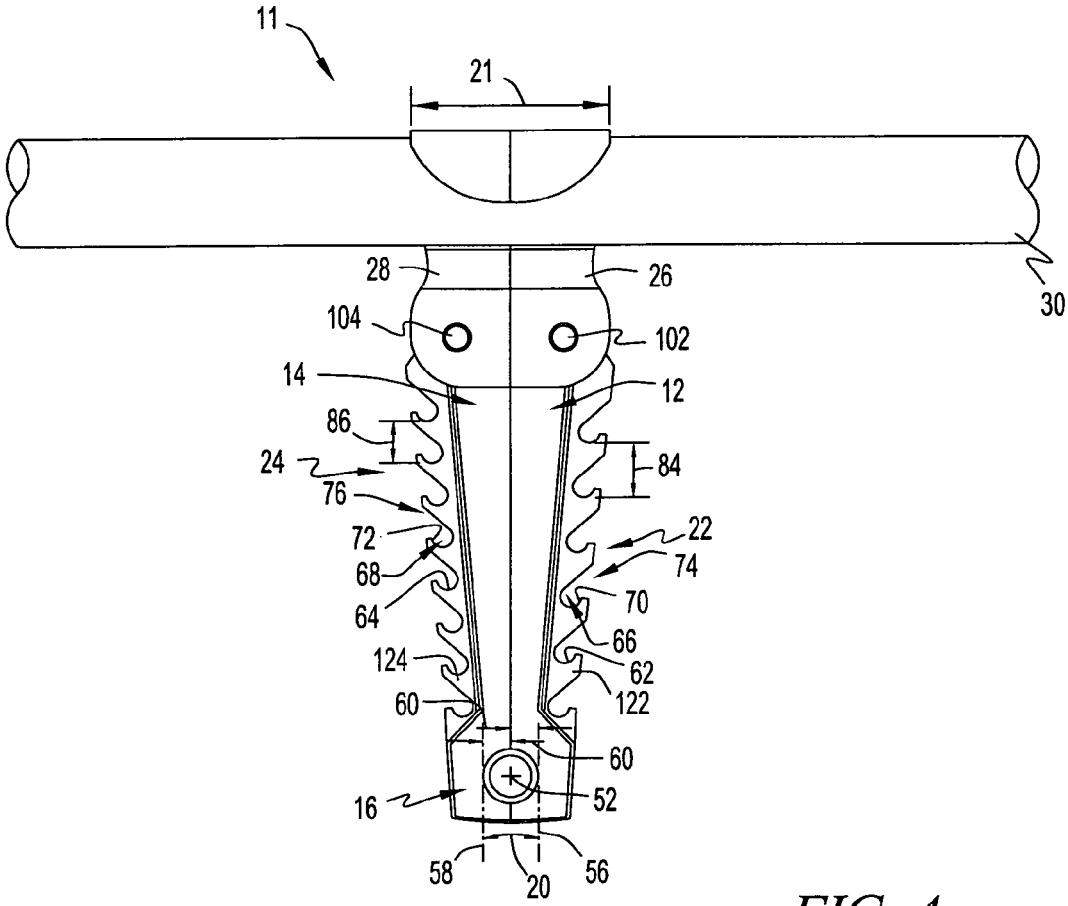
FIG. 4 is a rear view of the hanger system of FIG. 3 in a storage position.

The disclosed embodiments include systems, devices and methods for organizing clothing, including a hanger system that holds a plurality of conventional hangers, such as for hanging clothing items. The embodiments of the hanger system are operable to maintain the conventional hangers and/or their associated clothing items in a compressed state, when compared to typical horizontal storing of the hangers and/or items, which increases an available amount of space for hanging clothing items.

Referring to FIGS. 1–4, embodiments of a hanger system 10, 11 for clothing organization include a first member 12 movably connected to a second member 14 by a connector 16. Connector 16 allows relative movement of first member 12 and second member 14 between a first position (FIGS. 1 and 3) and a second position (FIGS. 2 and 4) relative to one another, such as may be respectively defined by a first angle 18 and a second angle 20. For example, the first relative position may be a loading and unloading position, where hanger systems 10, 11 have at least one first dimension 21, while the second relative position may be a storing position, where the hanger systems have at least one second dimension 23 less than first dimension 21. Further, first member 12 and second member 14 may each include at least one hanger positioning portion 22, 24 for receiving and suspending a conventional hanger, which may include clothing items thereon. Additionally, suspension mechanisms 26, 28 may be connected to a corresponding one of first member 12 and second member 14, for supporting the members, such as on a rod 30, in the first relative position and the second relative position. Hanger system 10 may also include a releasable member locking mechanism 32 for securing the first member 12 and a second member 14 at any predetermined relative position, such as in the first relative position or the second relative position. As such, hanger systems 10, 11 may be configured in the first relative position for the loading and/or unloading of conventional hangers into/out of hanger positioning portions 22, 24. Hanger systems 10, 11, and then moved into the second relative position for storage, thereby reducing the storage space used from first dimension 21 to second dimension 23. For example, when the conventional hangers hold clothing items, hanger system 10 allows these clothing items to be easily moved into and out of hanger positioning portions 22, 24 in the first relative position of members 12, 14, while the conventional hangers and/or clothing items become compressed laterally, and spaced apart vertically, by the movement of hanger system 10 into the second relative position of the members. Thus, hanger system 10 provides an easily accessible clothing organization system that increases the amount of clothing items storable in a given space.

First and second members 12, 14, in one embodiment, each include an elongated body 34, 36 with opposing proximal ends 38, 40 and distal ends 42, 44. Bodies 34, 36 may be substantially linear, curved and/or curvilinear. In alternate embodiments, rather than having a long and narrow shape, first and second members 12, 14 may have other body shapes, such as a circular shape, an oval shape, and other shapes where a length and a width of the members may be of a similar dimension. First and second members 12, 14 may have very similar structures, which may be mirror images of one another when affixed together by connector 16. Additionally, members 12, 14 may be configured in any size to achieve a desired savings in usage of lateral space and/or a desired usage of vertical space in the storing position.

Figure 5:
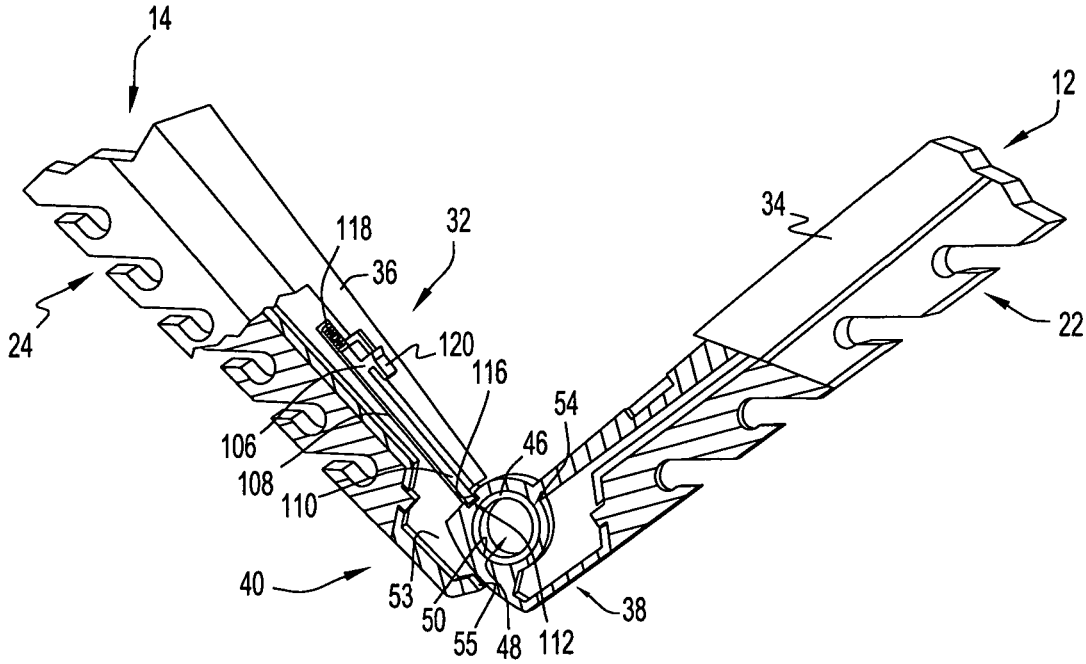
FIG. 5 is a partial sectional rear view of a portion of the hanger system of FIG. 3 including one embodiment of a connector that movably connects the two members, and including one embodiment of a locking mechanism for securing the members relative to one another.

Connector 16 may be defined by interconnecting integral portions of members 12, 14 in a relatively movable and/or rotatable manner. In one embodiment, for example, connector 16 is located at or adjacent to the respective proximal ends 38, 40 of members 12, 14. Alternatively, connector 16 may include at least one separate component, such as a pin, a bearing, a screw and a nut, and any other mechanism that movably connect first and second members 12, 14. Although a pivotal connection is illustrated, other embodiments of connector 16 may provide for relative linear and/or curvilinear motion. In one embodiment, for example referring to FIG. 5, second proximal end 40 includes a projection 46 extending from a side of body 36 that fits within a cavity 48 defined by an internal wall 50 within first proximal end 38. Projection 46 may have any exterior shape, such as a round shape, that allows for pivoting movement relative to cavity 48. Further, cavity 48 may be any corresponding shape, such as a round shape or a slotted shape, which allows relative rotation of projection 46. For example, as illustrated in FIG. 5, projection 46 may form an inner circle that fits within an outer circle formed by wall 50 that defines cavity 48. Further, each member 12, 14 may be formed from a front half and a back half that are secured together, where each front and back half includes the corresponding inner and outer circle structure described above to form connector 16. Alternatively, for example, projection 46 may be circular and cavity 48 may be in the form of a slot (not shown) having a long dimension substantially perpendicular to the longitudinal length of the respective member so as to allow relative rotation as well as relative lateral movement between members 12, 14. The relative lateral movement of projection 46 relative to the long axis of the slot embodiment (not shown) of cavity 48 provides connector 16 with an axis of rotation 52 (FIGS. 4 and 10) that is variably positionable, which may allow hanger system 10 to be moved into the second relative position, or storing position, even when loaded with bulky clothing items. Further, projection 46 may further include a radially extending portion 54 sized larger than at least a portion of cavity 48. Radially extending portion 54 may be resiliently deformed during installation through cavity 48 to thereafter overlap with wall 50 to substantially resist relative movement of proximal ends 38, 40 along axis of rotation 52 of connector 16. Alternatively, at least one of first and second members 12, 14 may include at least one limiting portion or stop, such as wall 53 and wall 55 of member 14, to provide a stop that limits the relative movement between members 12, 14 at connector 16. For example, wall 53 limits linear relative movement between members 12, 14 along axis of rotation 52 by providing a stop for at least one side surface of end 38 of member 12. Wall 55 limits rotational relative movement between members 12, 14 around axis of rotation 52 by providing a stop for at least an end surface of end 38 of arm 12. Additionally, referring to FIG. 4, axis of rotation 52 may be offset from at least one of the respective longitudinal axes 56, 58 of members 12, 14 by a predetermined distance 60 to allow for movement of members 12, 14 into the second relative position, or storing position. Predetermined distance 60 may vary depending on, for example, a desired second angle 20 between members 12, 14, a desired spacing between members 12, 14 while in the second relative position, etc.

First and second angles 18, 20 formed between members 12, 14 may vary between about −20 degrees and about 180 degrees. For example, suitable values of first angle 18 include: about 180 degrees in one embodiment; between about 150 degrees and about 180 degrees in another embodiment; between about 120 degrees and about 150 degrees in a further embodiment; between about 90 degrees and 120 degrees in yet another embodiment; between about 70 degrees and 110 degrees in a further embodiment; and about 90 degrees in another embodiment. Similarly, suitable values of second angle 20 include: about 0 degrees in one embodiment; between about 0 degrees and about 20 degrees in another embodiment; between about −15 degrees and about 15 degrees in a further embodiment; and between about −20 degrees and 20 degrees in yet another embodiment. The embodiments of first angle 18 and second angle 20 may be used in any combination to provide a desired first relative position and a desired second relative position of members 12, 14 to achieve a desired savings in usage of lateral space and/or a desired usage of vertical space in a storing position.

Referring again to FIG. 4, first and second hanger positioning portions 22, 24 each include a wall portion 62, 64, such as an outer edge, that define at least one respective hang locations 66, 68. Hang locations 66, 68 are sized to allow a hook portion of a conventional clothing hanger to move through each hang location 66, 68 so as to allow the conventional hanger to be received and hung or suspended on the respective wall portion 62, 64. Hang locations 66, 68 may vary in size, may all have the same size, or may be some combination of similar and different sizes. Each wall portion 62, 64 may be configured to support the conventional hanger while hanger system 10 is in the first relative position and the second relative position, and while moving between the relative positions. For example, wall portions 62, 64 may define hang locations 66, 68 having a closed shape, such as a circle, an oval, a slot, a square, a rectangle, and any other closed shape. In other words, hang locations 66, 68 having a closed shape may define a cavity extending through the respective member 12, 14 in one dimension, but the respective wall portions 62, 64 are closed or join back onto themselves so that hang locations 66, 68 are open in that single dimension. In other embodiments, wall portions 62, 64 may define hang locations 66, 68 having an open shape. In other words, hang locations 66, 68 having an open shape may define a cavity that extends through the respective member 12, 14 in a first dimension, and further includes another opening to the cavity in a second direction. For example, wall portions 62, 64 may define respective hook portions 70, 72 that define corresponding mouths 74, 76 that open to hang locations 66, 68. Mouths 74, 76 may be sized for receiving the hook portion of a conventional hanger, and hang locations 66, 68 may have the same or different sized mouths. In the embodiment of hang locations 66, 68 having an open shape, a part of each wall portion 62, 64 adjacent to the respective mouth 74, 76 may form an inclined angle with respect to a horizontal axis to resist sliding movement of the conventional hanger along wall portion 62, 64 and out of the respective hanger positioning portion 22, 24 through the corresponding mouth 74, 76. Additionally, hanger positioning portions 22, 24 may be located on members 12, 14 facing each other or facing away from each other.

Additionally, in embodiments of hanger system 10 having hanger positioning portions 22, 24 with a plurality of hang locations 66, 68 on each member 12, 14, the relative location of each hang location 66, 68 may have a predetermined spacing 84, 86 from the adjacent hang location to allow room for hanging conventional hangers with different types, styles and/or thicknesses of clothing items. Further, predetermined spacing 84 associated with first member 12 may be the same as, or may be different from, predetermined spacing 86 associated with second member 14. For example, predetermined spacing 84, 86 may be: equidistant between each of the plurality of hang locations 66, 68; a distance that is variable from one hang location 66, 68 to another; and a combination of fixed and variable distance spacings, such as a fixed distance between some subset of the plurality of hang locations 66, 68 and a variable distance between another subset of the plurality of hang locations 66, 68. Thus, the plurality of hang locations 66, 68 and predetermined spacings 84, 86 between adjacent hanger positioning portions allows for an efficient use of horizontal and/or vertical space for storing clothing items.

Figure 6:
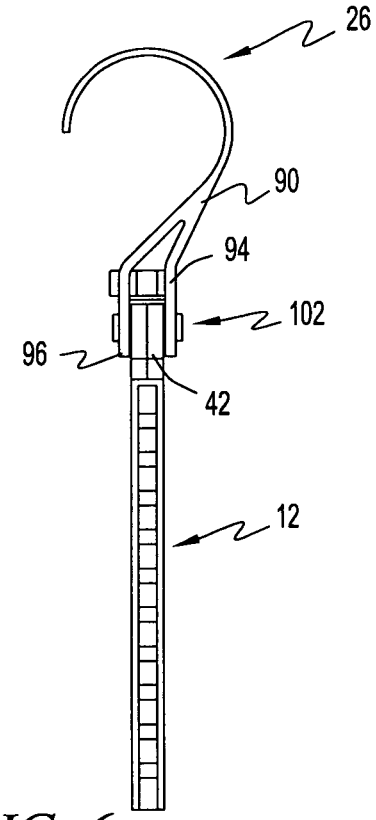
FIG. 6 is a left side view of the hanger system of FIG. 3.
Figure 7:
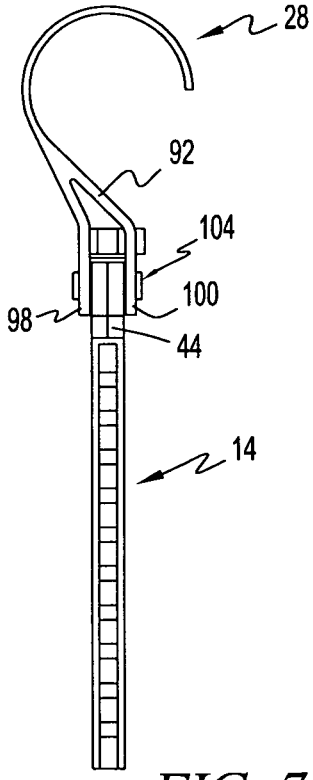
FIG. 7 is a right side view of the hanger system of FIG. 3.

Suspension mechanisms 26, 28 include any type of device or structure capable of supporting the respective member 12, 14, such as by holding onto a rod 30 or some other support member, including a supported one of members 12, 14. Suspension mechanisms 26, 28 include structures such as an open loop, a closed loop, a hook, a loop or hook with a bearing or roller, etc. Suspension mechanisms 26, 28 may be integrally formed at distal ends 42, 44 of members 12, 14, or separately attachable structures. Further, suspension mechanisms 26, 28 may have a fixed position relative to members 12, 14, or may have a variable position. For instance, suspension mechanisms 26, 28 may be movably connected to the respective member 12, 14 so as to allow relative rotational and/or linear and/or curvilinear motion during movement of hanger system 10 between the first and second relative position, i.e. the loading and storing positions. Referring specifically to FIGS. 6 and 7, for example, suspension mechanisms 26, 28 may respectively include body portions 90, 92 with extending, spaced apart flange portions 94, 96 and 98, 100 that fit over the corresponding member distal end 42, 44. Connectors 102, 104 may movably connect suspension mechanisms 26, 28 to the respective member 12, 14. In one embodiment, connectors 102, 104 are defined in corresponding structures formed on distal ends 42, 44 and flange portions 94, 96 and 98, 100, such as a pins extending from distal ends 42, 44 that are rotatably captured by corresponding openings or cavities within the respective flange portions 94, 96 and 98, 100. Alternately, connectors 102, 104 may include at least one separate component such as a pin, a bearing, etc. Other embodiments of connectors 102, 104 may provide linear and/or curvilinear relative movement between connectors 102, 104 and members 12, 14. Additionally, at least one suspension mechanism 26, 28 may be configured for relative sliding movement, such as on rod 30, during movement of hanger system 10 between the first and second relative position, i.e. the loading and storing positions.

Member locking mechanism 32 may be formed integrally with connector 16, and/or may be a separate structure. Further, one and/or a plurality of member locking mechanisms 32 may be positioned at any location between members 12, 14. For example, referring to FIG. 5, member locking mechanism 32 may have a body 106 movable in a channel 108 in first member 12 between a first unlocked position and a second locked position. In the second locked position, body 106 is engaged between first member 12 and second member 14 to substantially prevent relative movement in at least one dimension. The first unlocked position allows members 12, 14 to move relative to one another, while the second locked position secures members 12, 14 in a fixed relative position, such as in the loading/unloading position described above. In the second locked position, an end 110 of body 106 may fit within a cavity 112 formed in a rotating surface 114 of second member 14 to prevent relative movement between members 12, 14. For instance, the surface of end 110 of body 106 is locked in place by at least one limiting wall 116 that defines cavity 112. It should be noted that member locking mechanism 32 may have more than one locked position and more than one unlocked position. Additionally, a biasing mechanism 118, such as a spring or a resilient body, may urge end 110 into contact with a rotating surface 116 so as to force end 110 into cavity 112 when they are aligned. Further, member locking mechanism 32 may include a tab portion 120 rigidly attached to body 106 to enable a user to move member locking mechanism 32 between the first unlocked position and the second locked position.

Figure 8:
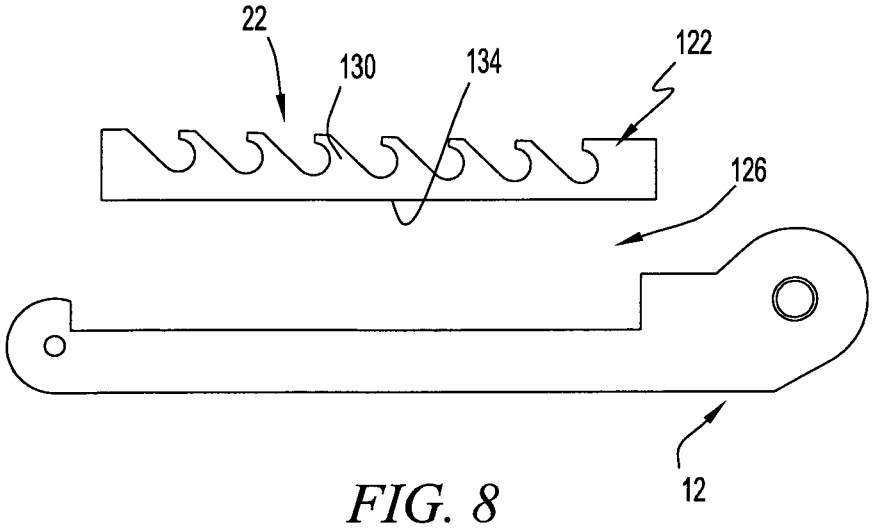
FIG. 8 is an exploded view one embodiment of an attachment member removably securable to a movable member of an embodiment of the hanger system.
Figure 9:
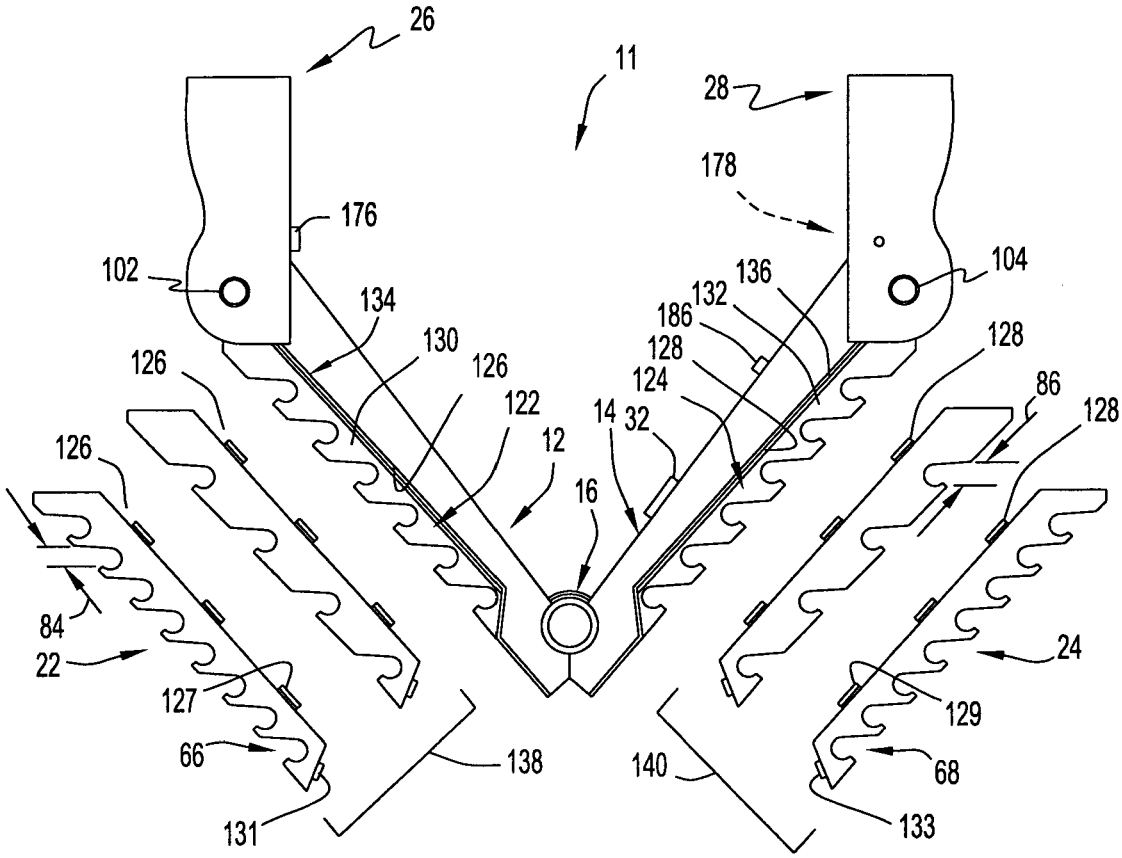
FIG. 9 is a front view of the hanger system of FIG. 3, including additional attachment members that may be included in a hanger system kit.

Further, referring specifically to FIGS. 8 and 9, embodiments of hanger positioning portions 22, 24 are defined on respective attachment members 122, 124, which may be removably connectable to respective mounting areas 126, 128 on each member 12, 14. Attachment members 122, 124 each may have an elongated body 130, 132 with a mounting edge 134, 136 that fits on and/or adjacent to mounting area 126, 128. The respective hang locations 66, 68 are defined on the respective edge opposite mounting edge 134, 136. In one embodiment, hanger system 10 may be a kit that includes a plurality of attachment members 138, 140, where different attachment members may have different configurations of a plurality of hang locations 66, 68 for example, with differing amounts of predetermined spacing 84, 86. Attachment members 122, 124 and respective members 12, 14 may be fixed together by securing mechanisms 126, 128 defined on corresponding portions of the respective member and member, or formed as separate structures. For example, securing mechanisms 126, 128 may include at least one of a latch, a hook, a snap, a pin and a hole or slot, a screw and a screw hole, and any other mechanism capable of removably securing members 122, 124 and members 12, 14. In the embodiment of FIG. 9, for example, securing mechanisms 126, 128 include projections 127, 129 extending from the respective body 130, 132 of attachment members 122, 124 toward the corresponding mounting area 126, 128 of members 12, 14. In this embodiment, projections 127, 129 include a body with a top flange such that a cross-section through the projection defines a T-shape. Correspondingly, mounting areas 126, 128 include mounting slots having a wide opening at one end and a narrow opening connected thereto. The wide opening is sized to receive the corresponding top flanges, and the narrow opening is sized to receive the body of the projection. Further, in this embodiment, securing mechanisms 126, 128 may include respective end projections 131, 133 that fit within corresponding end openings within members 12, 14. As such, to secure attachment members 122, 124 to members 12, 14, end projections 131, 133 are moved into end openings, and top flanges of projections 127, 129 are moved into the wide opening of mounting slots. Then attachment members 122, 124 are moved such that end projections 131, 133 are contained within end openings and the top flanges and bodies of projections 131, 133 are contained within the narrow openings of the mounting slots to thereby removably secure attachment members 122, 124 to members 12, 14.

Figure 11:
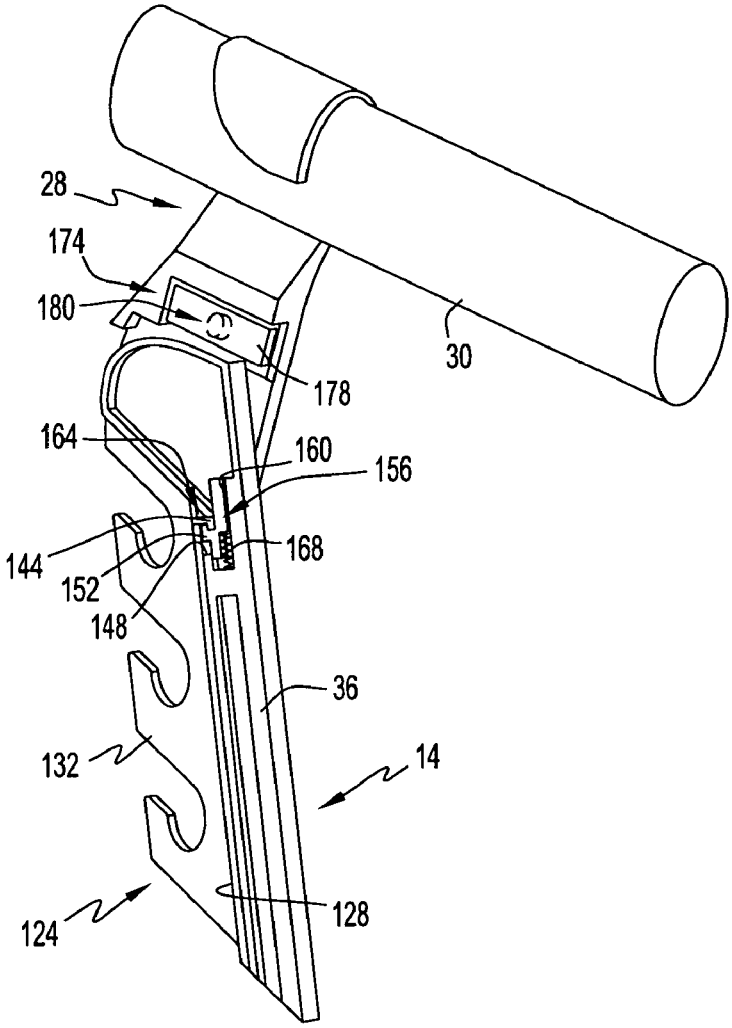
FIG. 11 is a partial sectional view of a movable member and a suspension member, such as in the hanger system of FIG. 3, and further including one embodiment of a storage locking mechanism and one embodiment of an attachment member locking mechanism.

In another embodiment, for example referring to FIG. 11, securing mechanism 128 may include a projection 144, extending from body 132, that fits within a corresponding limiting member 148 formed on member 14. Further, securing mechanism 128 may further include hook portion 152 extending from latch member 156 that is movable between locked and unlocked positions within channel 160 formed in member body 36 so as to removably affix member 124 to member 14. When projection 144 is inserted within an affixing location 164 defined as a cavity by limiting member or wall 148, latching member 156 is movable from the unlocked position to the locked position to catch projection 144 and thus secure attachment member 124 to member 14. Further, latching member 156 may include a biasing member 168 to urge the latching member toward the locked position. Additionally, latching member 156 may include a tab portion 172 (FIG. 12) rigidly connected to and extending from the body of latching member 156 to enable a user of the hanger system to adjust the latching member between the locked and unlocked positions.

Figure 12:
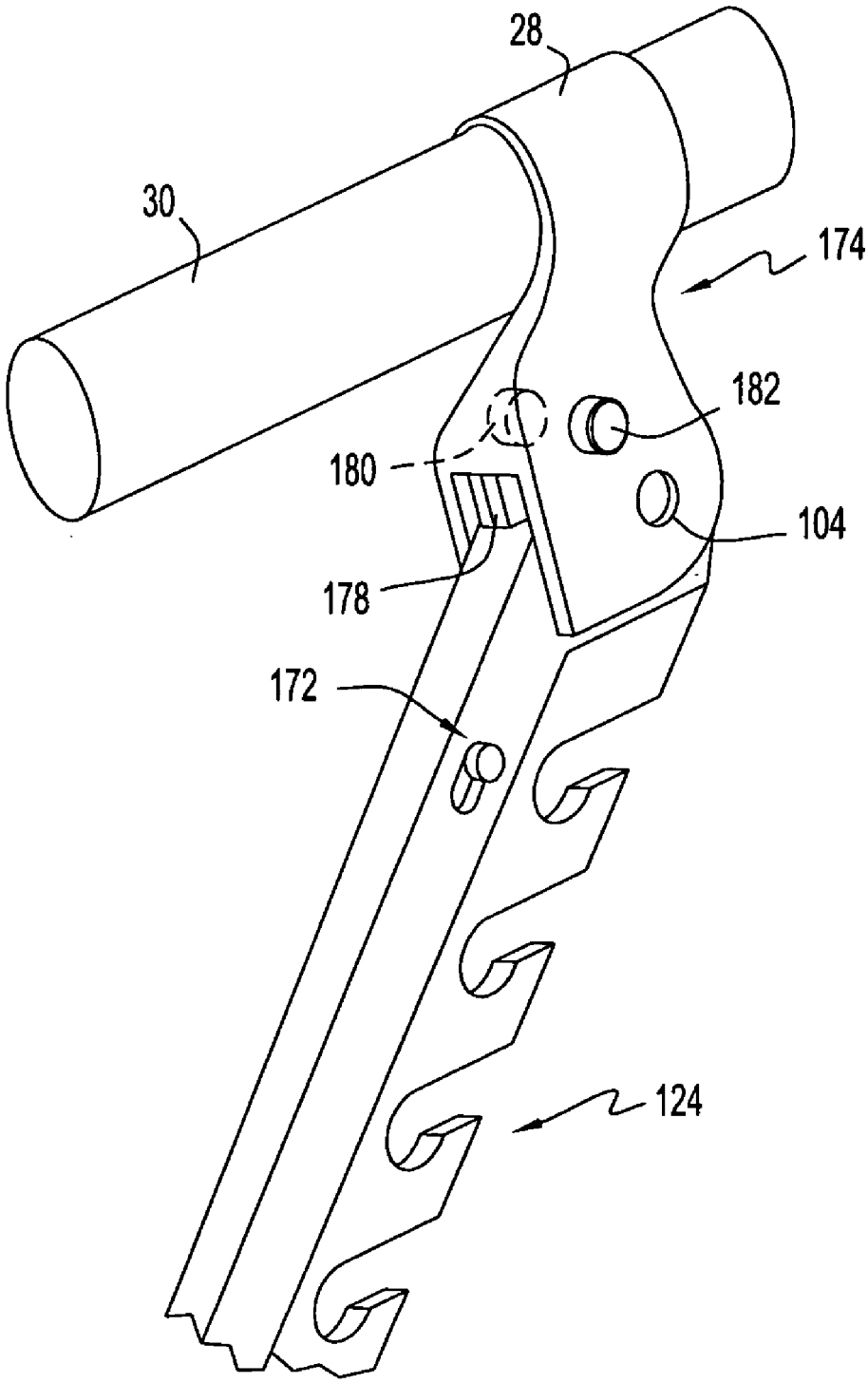
FIG. 12 is a front view corresponding to FIG. 11.

Additionally, referring to FIGS. 11–12, hanger system 11 may include a storage locking mechanism 174 operable to removably secure members 12, 14 in the second relative position, i.e. the storage position. For example, storage locking mechanism 174 may include a resilient locking flange, a latch mechanism, a pin mechanism, and any other mechanism that enables members 12, 14 to be secured together, such as in the storage position. For example, in one embodiment, storage locking mechanism 174 includes a first locking member 176 formed on or rigidly attached to first suspension mechanism 26 and a corresponding second locking member 178 associated with second suspension mechanism 28. For example, in one embodiment, locking members 176, 178 may include flanges with raised, interlocking hook portions. At least one of locking members 176, 178 may be resiliently deformable such that when members 12, 14 are moved into the second relative position, i.e. the storing position, the locking members 176, 178 overlap one another and their interlocking hook portions resist movement of members 12, 14 out of the storing position. Alternatively and/or in combination, at least one of locking members 176, 178 may be movably mounted within the respective suspension mechanism 26, 28, such as being movable so as to enable one locking member 176, 178 to move relative to the corresponding other locking member so that the hook portions can engage and disengage. Storage locking mechanism 174 may further include a biasing mechanism 180, such as a spring and/or a resilient member, for urging locking members 176, 178 into an engaged, or locked, relationship. Additionally, storage locking mechanism 174 may further include a release mechanism 182, such as a button or tab, which may be connected to one of locking members 176, 178. Release mechanism 182 may be movable between a first and a second position to correspondingly move the respective locking member into and out of a locking/engagement position. It should be noted that storage locking mechanism 174 may be considered as one type of member locking mechanism 32, as discussed above.

Figure 10:
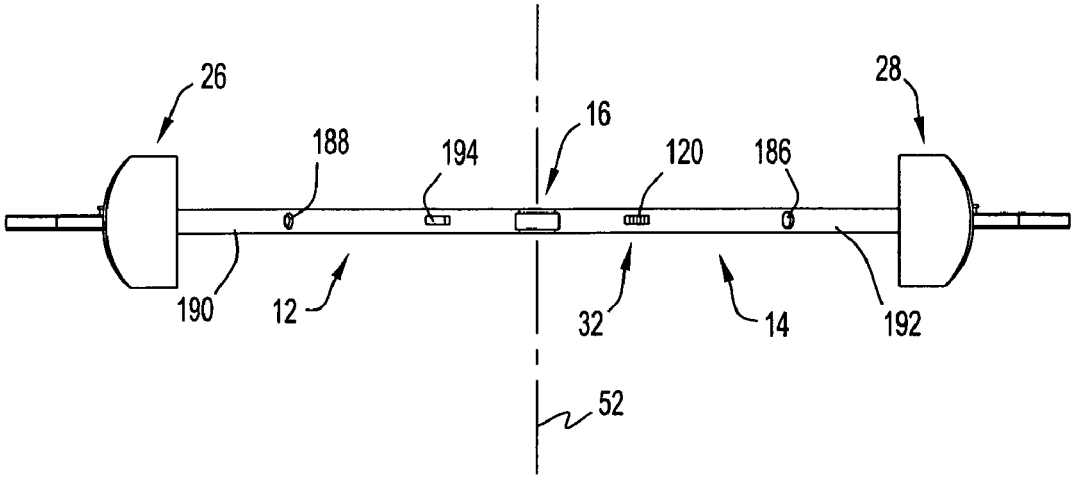
FIG. 10 is a top view of the hanger system of FIG. 3.

Additionally, referring to FIG. 10, in one embodiment at least one of members 12, 14 may include a locating member 186 extending therefrom to fit within a corresponding locating cavity 188 on the opposing member during movement of the members into the storing position. Locating member 186 and locating cavity 188 may aid in aligning members during movement into the storing position. Further, in embodiments where inside edges 190, 192 of members 12, 14 are substantially flush in the storing position, the one member 12, 14 opposite tab portion 120 of member locking mechanism 32 may include a recessed portion 194 to receive the tab portion 120 when the members are in the storing position. It should be noted, however, that embodiments of hanger systems that include member locking mechanism 32 may have tab portion 120 located on any surface of the respective member 12, 14, and thus recessed portion 194 may not be necessary.

The components of hanger systems 10, 11 may be formed from the same material or from different materials. Suitable examples of materials include plastics, metals, composites, rubbers, elastomers, etc. For example, in one embodiment, many of the components may be formed from injection molded plastics, with the biasing mechanisms formed from spring materials such as metals.

As such, in one embodiment, a method of assembling a hanger system includes connecting a first member having a first hanger positioning portion to a second member such that the second member and the first member are movable between a first position and a second position relative to one another. Further, the method includes connecting a first suspension member to one of the first member and the second member, where the first suspension member movably supports the respective one of the first member and the second member during movement between the first position and the second position. Additionally, the method may further include removably attaching the first hanger positioning portion to the first member. Another alternative to the method includes connecting a second suspension member to the other one of the first member and the second member, where the second suspension member movably supports the other one of the first member and the second member during movement between the first position and the second position. Further, the first suspension member and the second suspension member have a first spacing corresponding to the first position of the members and a second spacing corresponding to the second position of the members, where the first spacing is greater than the second spacing.

In another embodiment, a method of clothing organization includes hanging a hanger system by a first suspension mechanism and a second suspension mechanism, where the first suspension mechanism is attached to a first end of a first member and the second suspension mechanism is attached to a second end of the second member. The first member and the second member are movably connected at corresponding ends thereof, opposite the first end and the second end, such that the members are movable between a first position and a second position relative to one another. Further, the first member includes at least one hang location. Additionally, the method includes hanging at least one conventional hanger at the hang location while the members are in the first position, where the first suspension member and the second suspension member have a first spacing corresponding to the first position. And, the method includes moving the members into the second position, where the first suspension member and the second suspension member have a second spacing corresponding to the second position, where the first spacing is greater than the second spacing.

The result is a clothing organization system that allows a user to store clothing items on conventional hangers in a plurality of hang locations that are spaced apart in a vertical dimension when in a storing position, thereby reducing the amount of horizontal space used when compared to the typical horizontal storing of the conventional hangers and conventional hanger systems.

While the various disclosed embodiments have been illustrated and described, it will be clear that the subject matter of this document is not limited to these embodiments only. Numerous modifications, changes, variations, substitutions and equivalents will be apparent to those skilled in the art without departing from the spirit and scope of the disclosed embodiments as described in the claims.

What is claimed is:

1. A hanger system, comprising:

a first member having a first hanger positioning portion;

a second member connectable to the first member such that the second member and the first member are movable between a first relative position and a second relative position;

a first suspension mechanism attachable to the first member;

a second suspension mechanism attachable to the second member;

wherein the first suspension mechanism and the second suspension mechanism are operable to respectively support the first member and the second member in the first relative position and the second relative position; and wherein the first member and the second member each comprise a proximal end and a distal end, further comprising a connector pivotally connecting the first member and the second member adjacent to the corresponding proximal ends, and further comprising a first member locking mechanism and a second member locking mechanism, the first member locking mechanism attachable to one of the first member and the second member for securing the first member and the second member in at least one of the first relative position and the second relative position, the second member locking mechanism attachable to one of the first member and the second member for securing the first member and the second member in the other one of the first relative position and the second relative position.

2. The hanger system of claim 1, further comprising a first attachment member fixable to the first member, wherein the first attachment member includes the first hanger positioning portion.

3. The hanger system of claim 2, wherein the first hanger positioning portion defines at least one hang location for holding a hanger.

4. The hanger system of claim 3, wherein the hang location comprises a wall that defines a cavity extending through the first member sized for receiving the hanger, wherein the wall further defines one of an open shape and a closed shape.

5. The hanger system of claim 3, wherein the hang location comprises a hook.

6. The hanger system of claim 2, further comprising a securing mechanism for attaching the first attachment member to the first member.

7. The hanger system of claim 6, wherein the securing mechanism comprises at least one projection removably fixable within a corresponding limiting member, wherein the first attachment member includes one of the at least one projection and the corresponding limiting member, and wherein the first member includes the remaining one of the at least one projection and the corresponding limiting member.

8. The hanger system of claim 1, wherein at least one of the first suspension mechanism and the second suspension mechanism comprises a body portion movably connected relative to the corresponding one of the first member and the second member.

9. The hanger system of claim 8, wherein at least one of the first suspension mechanism and the second suspension mechanism comprises at least one of an open loop, a closed loop, a hook, a bearing, and a roller.

10. The system of claim 1, wherein the second member further comprises a second hanger positioning portion.

11. The hanger system of claim 10, wherein the first hanger positioning portion and the second hanger positioning portion each define at least one hang location for holding a hanger.

12. The hanger system of claim 11, wherein the hang locations associated with the first member and the second member include a hook portion that defines a mouth, wherein the mouths of the respective hook portions on the first member and the second member are positionable facing one another.

13. The hanger system of claim 1, further comprising a first attachment member fixable to the first member and a second attachment member fixable to the second member, wherein the first attachment member includes the first hanger positioning portion, wherein the second attachment member further comprises a second hanger positioning portion.

14. The hanger system of claim 13, wherein the first hanger positioning portion and the second hanger positioning portion each define a plurality of hang locations for holding a corresponding plurality of hangers.

15. The hanger system of claim 14, wherein the first relative position corresponds to a first lateral spacing of distal ends of the first member and the second member, and the second relative position corresponds to a second lateral spacing of the distal ends of the first member and the second member, wherein the first lateral spacing is greater than the second lateral spacing.

16. The hanger system of claim 1, wherein the first hanger positioning portion further comprises a body that defines a plurality of hang locations for holding a corresponding plurality of hangers, wherein each of the plurality of hang locations is separated by a corresponding plurality of predetermined spacings.

17. The hanger system of claim 16, wherein the plurality of predetermined spacings comprise at least a first spacing and a second spacing, wherein the first spacing and the second spacing are not equal.

18. The hanger system of claim 1, wherein at least one of the first suspension mechanism and the second suspension mechanism is movable with the respective one of the first member and the second member during movement of the members between the first relative position and the second relative position.

19. A hanger system, comprising:

a first member having a first hanger positioning portion;

a second member connectable to the first member such that the second member and the first member are movable between a first relative position and a second relative position;

a first suspension mechanism attachable to the first member;

a second suspension mechanism attachable to the second member;

wherein the first suspension mechanism and the second suspension mechanism are operable to respectively support the first member and the second member in the first relative position and the second relative position;

a first attachment member fixable to the first member, wherein the first attachment member includes the first hanger positioning portion; and a securing mechanism for attaching the first attachment member to the first member, wherein the securing mechanism includes a latch mechanism comprising a projection movable between a locked position and an unlocked position to respectively secure and release the first attachment member.

20. The hanger system of claim 19, further comprising a member locking mechanism attachable to at least one of the first member and the second member for securing the first member and the second member in at least one of the first relative position and the second relative position.

21. The hanger system of claim 20, wherein the member locking mechanism includes a body engageable with both the first member and the second member, the body being movable between a locked position and an unlocked position, wherein the first member and the second member are movable between the first relative position and the second relative position when the member locking mechanism is in the unlocked position.

22. The hanger system of claim 20, wherein the first member and the second member each comprise a proximal end and a distal end, further comprising a connector pivotally connecting the first member and the second member adjacent to the corresponding proximal ends, wherein the member locking mechanism is located at at least one point between the proximal ends and the distal end.

23. The hanger system of claim 19, wherein the first member and the second member each further comprise a proximal end and a distal end, wherein the first member and the second member are pivotally connectable adjacent to the corresponding proximal ends of the respective members.

24. The hanger system of claim 23, wherein the first suspension mechanism and the second suspension mechanism are respectively attachable adjacent to the respective distal ends of the respective members.

25. The hanger system of claim 19, wherein the first suspension mechanism and the second suspension mechanism have a first spacing corresponding to the first relative position of the members and a second spacing corresponding to the second relative position of the members, wherein the first spacing is greater than the second spacing.

26. A hanger system, comprising:

a first member having a first plurality of hang locations for holding hangers, wherein each of the first plurality of hang locations is separated by a corresponding first plurality of predetermined spacings;

a second member pivotally connectable to the first member at corresponding ends thereof such that the second member and the first member are rotatably movable between a first position and a second position relative to one another, the second member having a second plurality of hang locations for holding hangers, wherein each of the second plurality of hang locations is separated by a corresponding second plurality of predetermined spacings;

a first suspension mechanism attachable to a first opposing end, opposite the corresponding ends, of the first member, the first suspension mechanism pivotally connectable the first member;

a second suspension mechanism attachable to a second opposing end, opposite the corresponding ends, of the second member, the second suspension mechanism pivotally connectable to the second member; and wherein the first suspension mechanism and the second suspension mechanism have a first spacing corresponding to the first position of the members and a second spacing corresponding to the second position of the members, wherein the first spacing is greater than the second spacing, wherein the first suspension mechanism and the second suspension mechanism are configured for relative sliding movement with respect to a rod supporting the first suspension mechanism and the second suspension mechanism during the movement between the first position and the second position, and wherein the first suspension mechanism and the second suspension mechanism are operable to pivot relative to the corresponding one of the first member and the second member during the movement between the first position and the second position.

27. The hanger system of claim 26, wherein at least one of the first suspension mechanism and the second mechanism is pivotally connected to the respective one of the first member and the second member.

28. The hanger system of claim 26, wherein each of the first plurality of hang locations and the second plurality of hang locations comprises a wall that defines a cavity extending through the first member sized for receiving a hanger, wherein the wall further defines one of an open shape and a closed shape.

29. The hanger system of claim 26, further comprising a first member locking mechanism and a second member locking mechanism, the first member locking mechanism attachable to one of the first member and the second member for securing the first member and the second member in at least one of the first relative position and the second relative position, the second member locking mechanism attachable to one of the first member and the second member for securing the first member and the second member in the other one of the first relative position and the second relative position.

30. The hanger system of claim 26, further comprising a first attachment member fixable to the first member and a second attachment member fixable to the second member, wherein the first attachment member comprises the first plurality of hang locations, wherein the second attachment member comprises the second plurality of hang locations, further comprising a first securing mechanism for attaching the first attachment member to the first member and a second securing mechanism for attaching the second attachment member to the second member, wherein each of the first securing mechanism and the second securing mechanism comprises a latch mechanism comprising a projection movable between a locked position and an unlocked position to respectively secure and release the respective one of the first attachment member and the second attachment member.

31. A hanger system kit, comprising:

a first member having a first mounting area;

a second member connectable to the first member at corresponding ends thereof such that the second member and the first member are movable between a first position and a second position relative to one another;

a first attachment member having a first plurality of hang locations with a first set of predetermined spacings therebetween, the first attachment member removably attachable to the first mounting area;

a second attachment member having a second plurality of hang locations with a second set of predetermined spacings therebetween, the second attachment member removably attachable to the first mounting area;

a first suspension mechanism attachable to an opposing end, opposite the corresponding ends, of one of the first member and the second member; and wherein the first suspension mechanism is operable to support the respective one of the first member and the second member in the first relative position and the second relative position.

32. The hanger system kit of claim 31 further comprising a second suspension mechanism attachable to an opposing end, opposite the corresponding ends, of the other one of the first member and the second member, wherein the second suspension mechanism is operable to support the other one of the first member and the second member in the first position and the second position.

33. The hanger system kit of claim 31, further comprising a first member locking mechanism and a second member locking mechanism, the first member locking mechanism attachable to one of the first member and the second member for securing the first member and the second member in at least one of the first position and the second position, the second member locking mechanism attachable to one of the first member and the second member for securing the first member and the second member in the other one of the first position and the second position.

34. The hanger system kit of claim 31, wherein the second member further comprises a second mounting area, wherein either of the first attachment member and the second attachment member are removably attachable to the second mounting area, and further comprising a first securing mechanism for attaching either of the first attachment member and the second attachment member to the first member and a second securing mechanism for attaching either of first attachment member and the second attachment member to the second member, wherein each of the first securing mechanism and the second securing mechanism comprises a latch mechanism comprising a projection movable between a locked position and an unlocked position to respectively secure and release the respective attachment member.

* * * * *